US008534166B2

(12) United States Patent
Hsu

(10) Patent No.: US 8,534,166 B2
(45) Date of Patent: Sep. 17, 2013

(54) SCREWDRIVER DEVICE FOR AN INHERENT TOOL BIT SET

(76) Inventor: Shao-Hsien Hsu, Taichung (TW)

( * ) Notice: Subject to any disclaimer, the term of this patent is extended or adjusted under 35 U.S.C. 154(b) by 342 days.

(21) Appl. No.: 13/149,998

(22) Filed: Jun. 1, 2011

(65) Prior Publication Data

US 2012/0304835 A1 Dec. 6, 2012

(51) Int. Cl.
*B25G 1/08* (2006.01)
*B25B 23/00* (2006.01)

(52) U.S. Cl.
USPC ..... 81/177.4; 81/490; 81/439

(58) Field of Classification Search
USPC ..... 81/177.4, 490, 437–439; 206/234, 206/377
See application file for complete search history.

(56) References Cited

U.S. PATENT DOCUMENTS 5,499,562 A * 3/1996 Feng ..... 81/177.4
5,675,866 A * 10/1997 Tseng ..... 81/177.4
7,281,455 B2 * 10/2007 Hu ..... 81/177.4
8,037,577 B2 * 10/2011 Chen ..... 81/490
8,443,973 B1 * 5/2013 Hsu ..... 81/177.4

* cited by examiner

*Primary Examiner* — Hadi Shakeri

(57) ABSTRACT

A screwdriver for an inherent tool bit set includes a screwdriver device, a cover member and at least one control set. The screwdriver device has an accommodating portion at one end. A plurality of accommodating rooms is formed on the accommodating portion for receiving a tool bit set. At least one spring room is deposited on the accommodating portion. The screwdriver device has a working shaft at another end. The cover member has a receiving space. At least one through hole is opened on the cover member. The through hole corresponds to the spring room. The control set is assembled between the spring room and the through hole. Thus, a user presses the control set into the spring rooms for separating the cover member from the screwdriver device and takes a tool bit to assemble to the working shaft for screwing or loosing bolts.

6 Claims, 6 Drawing Sheets

SCREWDRIVER DEVICE FOR AN INHERENT TOOL BIT SET

BACKGROUND OF THE INVENTION

1. Field of the Invention

The present invention relates to a screwdriver, more particularly to a screwdriver device for an inherent tool bit set which a tool bit set is accommodated in a screwdriver device.

2. Description of Related Art

Screwdrivers are ordinary and widely using in houses and factories. People often assemble and fix things by using screwdrivers. Day after day, many manufacturers work hard not only to improve the quality of screwdrivers but to produce more functional screwdrivers. Thus, people can choose and use various screwdrivers to attach or to detach things easily today.

A conventional screwdriver includes an operating handle, a shaft fixed to the operating handle, and a tool bit extended from the shaft. A tool bit has particular structure and size corresponding to a particular bolt or a particular nut. If people want to screw bolts with different size and structure, or nuts with different size and structure, various screwdrivers are necessary in the task. In order to make users more convenient, some screwdrivers have a series of shafts with different tool bits that are assembled to the operating handle freely. However, users need a tool box to receive the various screwdrivers or a series of shafts. The tool box not only costs the users money but occupies the space in their houses.

The present invention has arisen to mitigate and/or obviate the disadvantages of the conventional.

SUMMARY OF THE INVENTION

The main objective of the present invention is to provide an improved screwdriver to accommodate a tool bit set for saving space and cost.

To achieve the objective, a screwdriver for an inherent tool bit set comprises a screwdriver device having an accommodating portion at one end thereof, a plurality of accommodating rooms formed on the accommodating portion for receiving a tool bit set, at least one spring room deposited on the accommodating portion, a working shaft at another end of the screwdriver device, a cover member having a receiving space at one end thereof for receiving the accommodating portion of the screwdriver device, at least one through hole opened on the cover member, the through hole communicated with the receiving space and corresponding to the spring room, at least one control set assembled between the spring room and the through hole, wherein a user presses the control set into the spring room for separating the cover member from the screwdriver device and takes a tool bit to assemble to the working shaft for screwing or loosing bolts, the control set further comprising a spring and a driving block, the spring being set between the spring room and the driving block, thereby the cover member is separated from the screwdriver device when the driving block is pressed through the through hole completely and the spring is compressed into the spring room simultaneously, at least one button room being set on the cover member, the button room communicated with the through hole, an elastic member placed into the button room, a pushing block formed at one end of the elastic member and corresponding to the through hole, the pushing block against and above the driving block, at least one locking hole opened on the button room, a button shield assembled to the button room and above the elastic member, at least one finger deposited at the button shield, wherein the finger is locking into the locking hole, a button formed on the elastic member and above the pushing block, a button hole opened on the button shield, wherein the button is received through the button hole, at least one lock portion formed on the walls of the accommodating rooms for receiving the tool bit firmly, a floor extended from a bottom of the accommodating rooms, the tool bit set received at an exact depth in the accommodating rooms through the floor, a spring fastener deposited at a terminal of the accommodating portion, a rear spring placed on the spring fastener and resisting against a bottom of the receiving space, two hook portions deposited at two lateral sides of the accommodating portion, two tracks deposited at two sides and along the walls of the receiving space, the two tracks corresponding to the two hook portions respectively.

Further benefits and advantages of the present invention will become apparent after a careful reading of the detailed description with appropriate reference to the accompanying drawings.

DETAILED DESCRIPTION OF THE INVENTION

Figure 1:
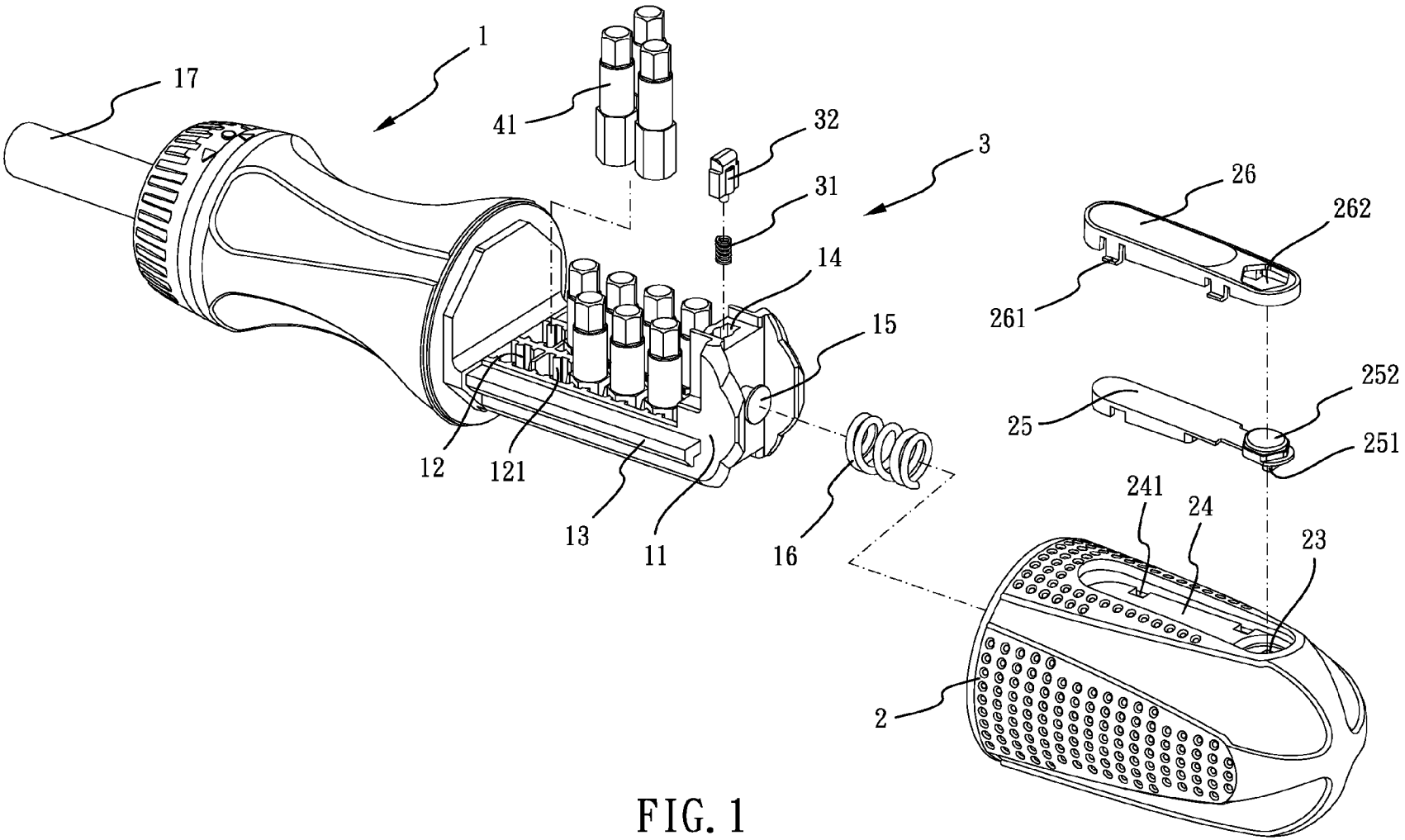
FIG. 1 is an exploded view of a screwdriver device for an inherent tool bit set in accordance with the present invention.
Figure 2:
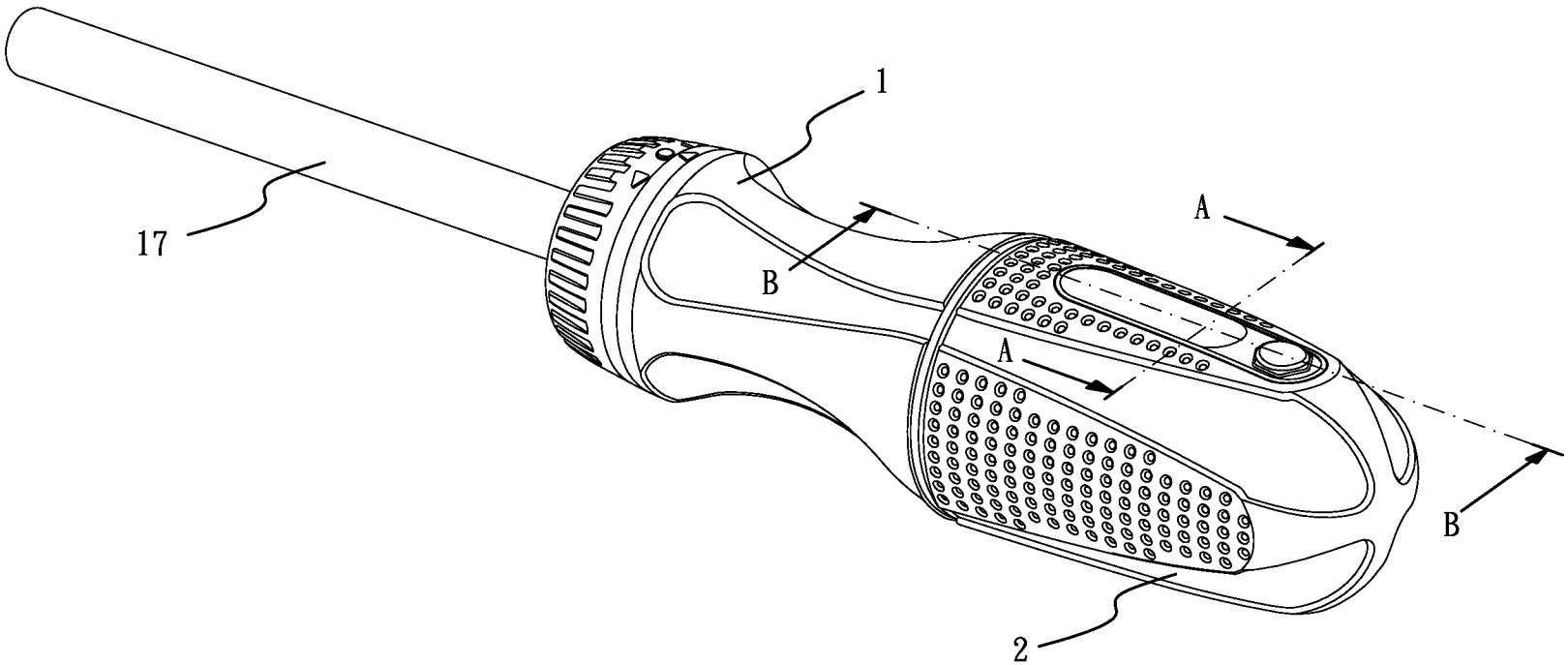
FIG. 2 is an assembled view of the screwdriver device for an inherent tool bit set in accordance with the present invention.
Figure 3:
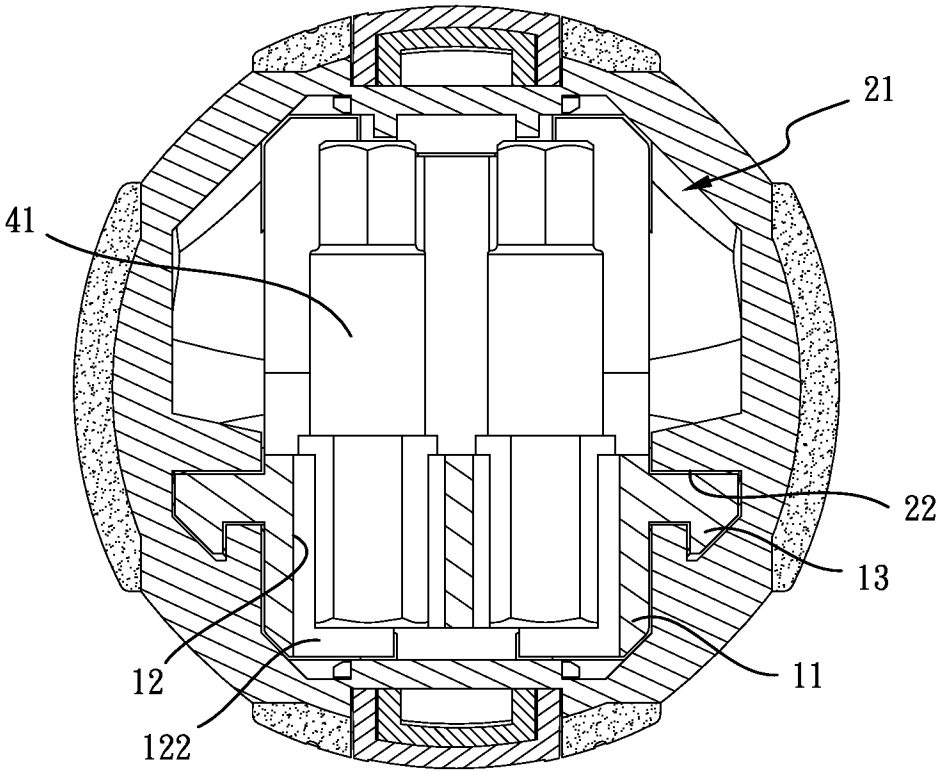
FIG. 3 is a cross-sectional view of the screwdriver device for an inherent tool bit set along a line AA shown in FIG. 2.

Referring to the drawings to FIGS. 1-4, a screwdriver for an inherent tool bit set in accordance with the present invention comprises a screwdriver device 1. The screwdriver device 1 has an accommodating portion 11 at one end thereof. A plurality of accommodating rooms 12 are formed on the accommodating portion 11 for receiving a tool bit set 41. At least one lock portion 121 is formed on the walls of the accommodating rooms 12 for receiving a tool bit within the tool bit set 41 firmly. A floor 122 is extended from a bottom of the accommodating rooms 12 as showing in FIG. 3, wherein the tool bit set 41 are received at an exact depth in the accommodating rooms 12 through the floor 122. Two hook portions 13 are deposited at two lateral sides of the accommodating portion 11. At least one spring room 14 is deposited on the accommodating portion 11. A spring fastener 15 is deposited at a terminal of the accommodating portion 11, wherein a rear spring 16 is placed on the spring fastener 15. The screwdriver device 1 has a working shaft 17 at another end thereof. Each of tool bit within the tool bit set 41 is assembled to one end of the working shaft 17 alternatively.

A cover member 2 has a receiving space 21 at one end thereof for receiving the accommodating portion 11 of the screwdriver device 1. Two tracks 22 are deposited at two sides and along the walls of the receiving space 21, wherein the two tracks 22 are corresponding to the two hook portions 13 respectively. The rear spring 16 placed on the spring fastener 15 is resisting against a bottom in the receiving space 21. At least one through hole 23 is opened on the cover member 2, wherein the through hole 23 is communicated with the receiving space 21 and corresponding to the spring room 14. At least one button room 24 is set on the cover member 2 (Here are two button rooms 24 in the present invention.). The button room 24 is communicated with the through hole 23. At least one locking hole 241 is opened on the button room 24. An elastic member 25 is placed into the button room 24. A pushing block 251 is formed at one end of the elastic member 25 and corresponding to the through hole 23. A button 252 is formed on the elastic member 25 and above the pushing block 251. A button shield 26 is assembled to the button room 24 and above the elastic member 25. At least one finger 261 is deposited at the button shield 26, wherein the finger 261 is locking into the locking hole 241. A button hole 262 is opened on the button shield 26, wherein the button 252 is received through the button hole 262.

At least one control set 3 is assembled between the spring room 14 and the through hole 23 (Here are two control sets 3 in the present invention.). The control set 3 further comprises a spring 31 and a driving block 32. The driving block 32 is placed into the through hole 23, wherein the pushing block 251 of the elastic member 25 is against and above the driving block 32. The spring 31 is set between the spring room 14 and the driving block 32.

Figure 4:
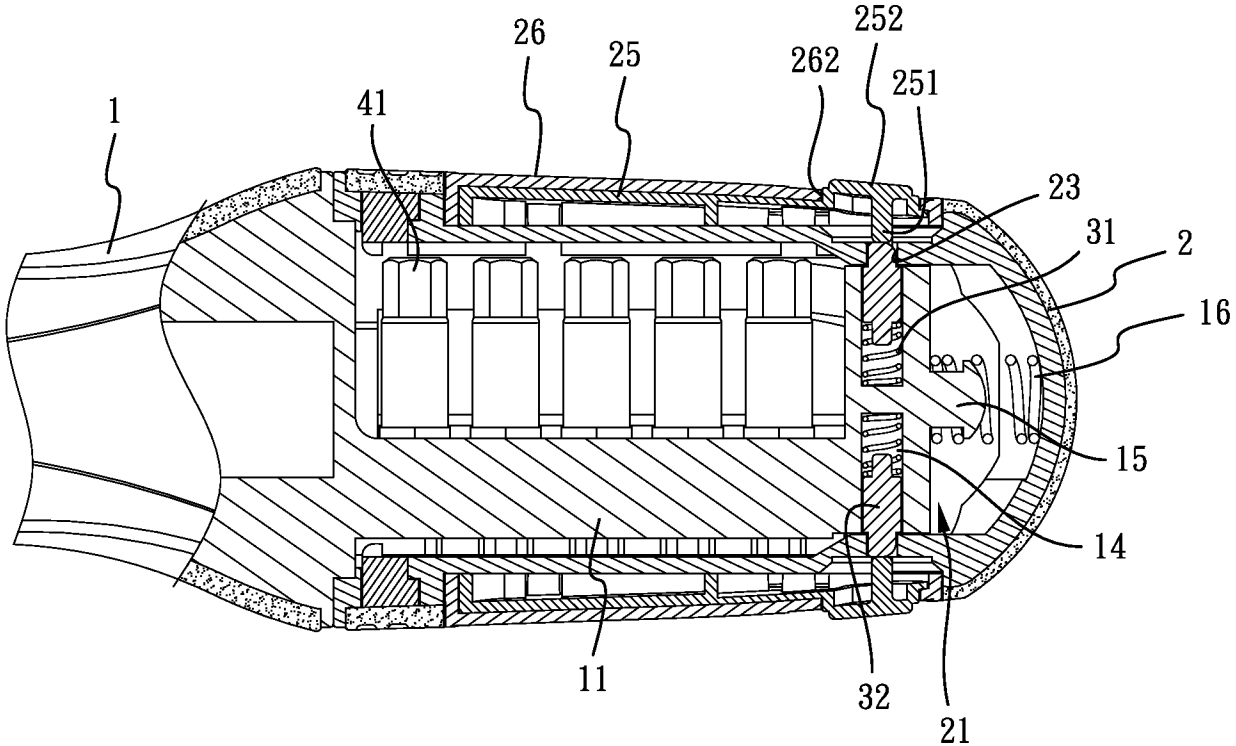
FIG. 4 is a cross-sectional view of the screwdriver device for an inherent tool bit set along a line BB shown in FIG. 2.
Figure 5:
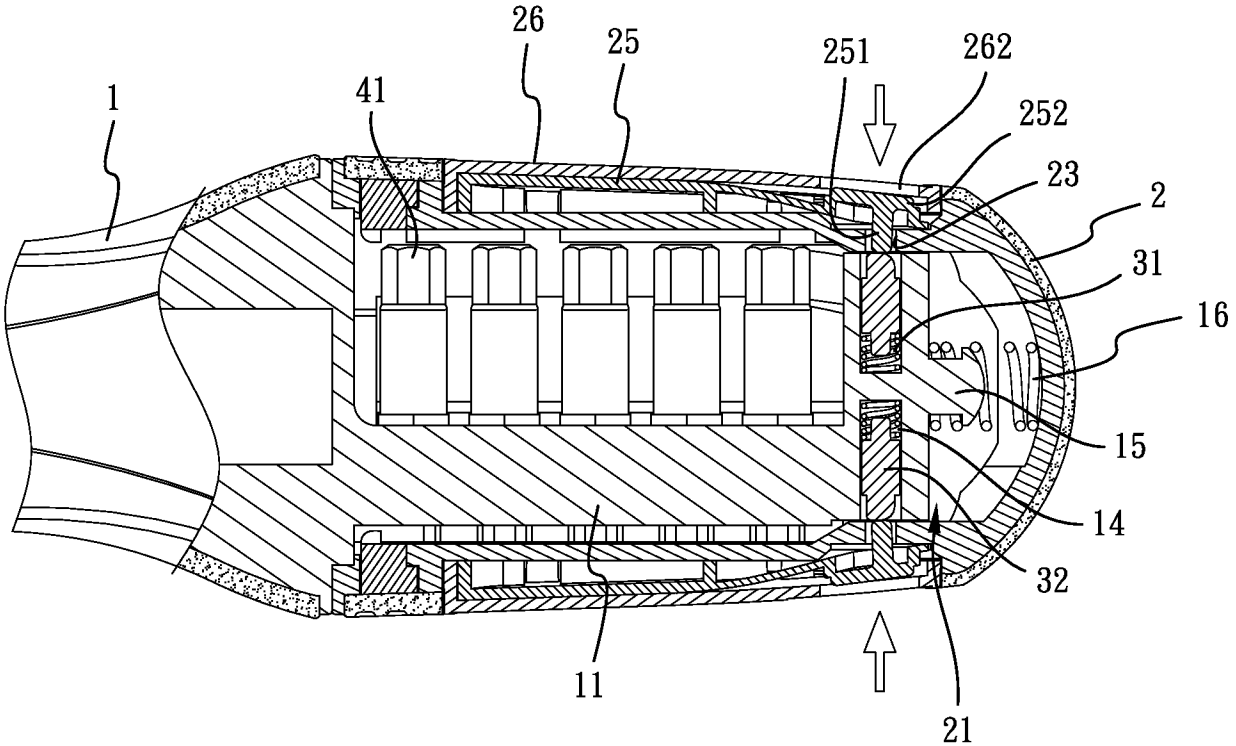
FIG. 5 is a partial assembled view for showing a user pressing two buttons of the present invention.
Figure 6:
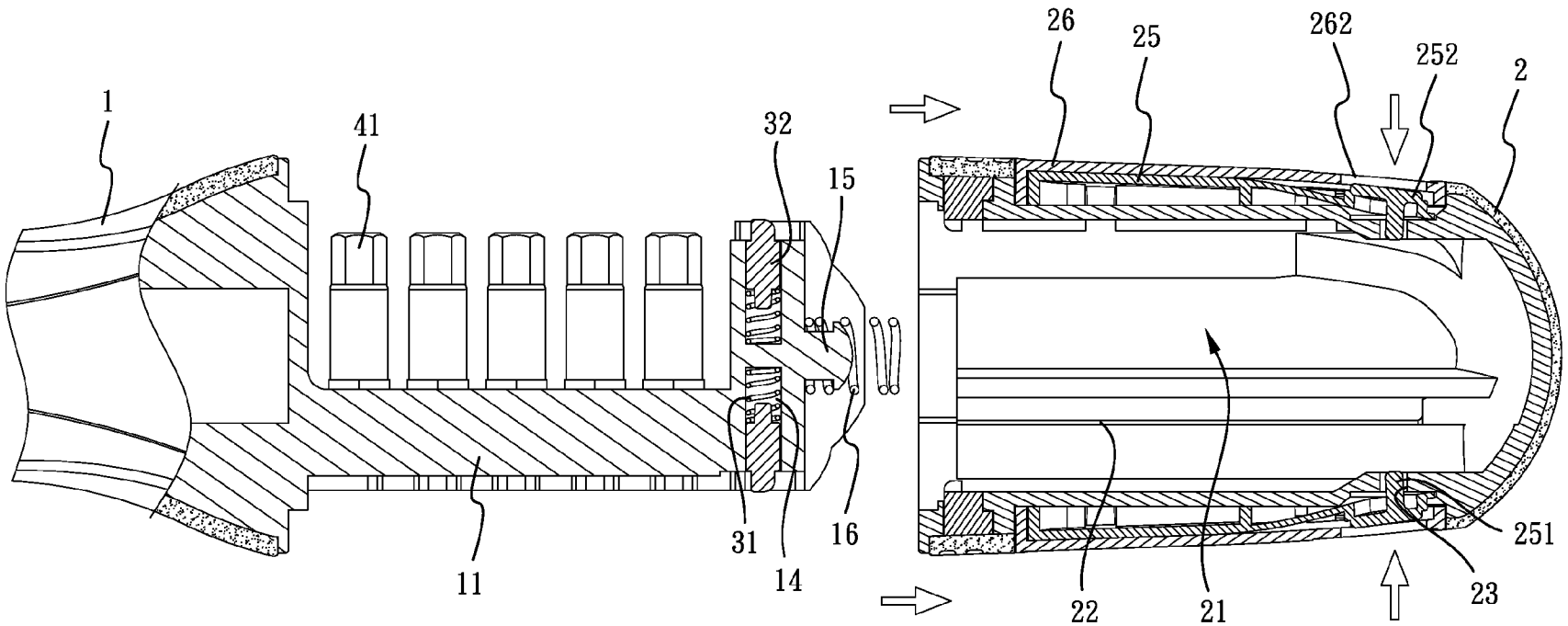
FIG. 6 is a partial assembled view for showing a cover member being taken off from a screwdriver device in the present invention.

Referring to the drawings to FIGS. 4-6, the cover member 2 encloses the accommodating portion 11 of screwdriver device 1 and the hook portions 13 on the accommodating portion 11 are engaging with the track 22 so that the cover member 2 cannot rotate along the screwdriver device 1 relatively. Therefore, a user can grip the screwdriver device 1 and the cover member 2 to screw or to loose bolts. In addition, the driving block 32 is pushed by the spring 31 so that the driving block 32 occupies the through hole 23 completely. Consequently, the cover member 2 cannot move axially along the screwdriver device 1 and cannot escape easily from the screwdriver device 1.

When the user want to take one tool bit within the tool bit set 41 from the accommodating portion 11, the user presses two buttons 252 so that the pushing blocks 251 below the buttons 252 push the driving blocks 32 into the spring rooms 14 and compress the springs 31 simultaneously. After the end of the driving block 32 moves through the through hole 23 completely, the user can pull cover member 2 back and the rear spring 16 placed on the spring fastener 15 also pushes the cover member 2 back. Finally, the cover member 2 quickly slides out from the accommodating portion 11. Therefore, the user can quickly take off the cover member 2 from the accommodating portion 11 and take one tool bit within the tool bit set 41 to assemble to the working shaft 17.

After the user alternates one tool bit from another, a prior tool bit is placed into the accommodating room 12 on the accommodating portion 11. The user further moves the cover member 2 forward along the hook portions 13 through the tracks 22 until the button 252 is received through the button hole 262, wherein the driving block 32 pushed by the spring 31 pushes the pushing block 251 and the button 252 toward the button hole 262. Consequently, the user puts the screwdriver device 1 and cover member 2 together again for doing another task.

Although the invention has been explained in relation to its preferred embodiment, it is to be understood that many other possible modifications and variations can be made without departing from the spirit and scope of the invention as hereinafter claimed.

What is claimed is:

1. A screwdriver for an inherent tool bit set comprising:

a screwdriver device having an accommodating portion at one end thereof, a plurality of accommodating rooms formed on the accommodating portion for receiving a tool bit set, at least one spring room deposited on the accommodating portion, a working shaft at another end of the screwdriver device;

a cover member having a receiving space at one end thereof for receiving the accommodating portion of the screwdriver device, at least one through hole opened on the cover member, the through hole communicated with the receiving space and corresponding to the spring room;

at least one control set assembled between the spring room and the through hole, the control set having a spring and a driving block, the spring disposed between the spring room and the driving block, at least one button room defined in the cover member, the button room communicated with the through hole;

an elastic member placed into the button room, a pushing block formed at one end of the elastic member and corresponding to the through hole, the pushing block against and above the driving block; and at least one locking hole opened on the button room, a button shield assembled to the button room and above the elastic member, at least one finger deposited at the button shield, the finger locking into the locking hole;

wherein a user presses the control set into the spring room for separating the cover member from the screwdriver device and takes a tool bit to assemble to the working shaft for screwing or loosing bolts.

2. The screwdriver for an inherent tool bit set as claimed in claim 1, wherein a button is formed on the elastic member and above the pushing block, a button hole opened on the button shield, the button received through the button hole.

3. The screwdriver for an inherent tool bit set as claimed in claim 1, wherein at least one lock portion is formed on the walls of the accommodating rooms for receiving the tool bit firmly.

4. The screwdriver for an inherent tool bit set as claimed in claim 1, wherein a floor is extended from a bottom of the accommodating rooms, the tool bit set received at an exact depth in the accommodating rooms through the floor.

5. The screwdriver for an inherent tool bit set as claimed in claim 1, wherein a spring fastener is deposited at a terminal of the accommodating portion, a rear spring placed on the spring fastener and resisting against a bottom of the receiving space.

6. The screwdriver for an inherent tool bit set as claimed in claim 1, wherein two hook portions are deposited at two lateral sides of the accommodating portion, two tracks deposited at two sides and along the walls of the receiving space, the two tracks corresponding to the two hook portions respectively.

* * * * *